US011101549B2

(12) United States Patent
Baek et al.

(10) Patent No.: US 11,101,549 B2
(45) Date of Patent: Aug. 24, 2021

(54) ANTENNA MODULE INCLUDING INSULATOR, AND BASE STATION INCLUDING SAME ANTENNA MODULE

(71) Applicant: Samsung Electronics Co., Ltd., Suwon-si (KR)

(72) Inventors: Kwanghyun Baek, Suwon-si (KR); Junsig Kum, Suwon-si (KR); Youngju Lee, Suwon-si (KR); Jungyub Lee, Suwon-si (KR); Yonghun Cheon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/733,363

(22) PCT Filed: Jan. 21, 2019

(86) PCT No.: PCT/KR2019/000842
§ 371 (c)(1),
(2) Date: Jul. 9, 2020

(87) PCT Pub. No.: WO2019/143211
PCT Pub. Date: Jul. 25, 2019

(65) Prior Publication Data

US 2021/0098863 A1 Apr. 1, 2021

(30) Foreign Application Priority Data

Jan. 19, 2018 (KR) ..... 10-2018-0007077

(51) Int. Cl.
*H01Q 1/52* (2006.01)
*H01Q 21/00* (2006.01)
(Continued)

(52) U.S. Cl.
CPC ..... *H01Q 1/246* (2013.01); *H01Q 1/42* (2013.01); *H01Q 1/523* (2013.01); *H01Q 21/0025* (2013.01); *H01Q 21/061* (2013.01)

(58) Field of Classification Search
CPC ..... H01Q 1/246; H01Q 1/52; H01Q 1/521; H01Q 1/523; H01Q 21/0006;
(Continued)

(56) References Cited

U.S. PATENT DOCUMENTS 10,418,725 B2 9/2019 Yang et al.
10,965,031 B2 * 3/2021 Shin ..... H01Q 9/045
(Continued)

FOREIGN PATENT DOCUMENTS

CN 201408837 Y 2/2010
CN 101673881 A 3/2010
(Continued)

OTHER PUBLICATIONS

Supplementary European Search Report in connection with European Application No. 19741006.1 dated Oct. 28, 2020, 9 pages.
(Continued)

*Primary Examiner* — Jason Crawford

(57) ABSTRACT

The present invention relates to: a communication technique for converging an IoT technology with a 5G communication system for supporting a higher data transfer rate beyond the 4G system; and a system therefor. The present invention provides an antenna module including at least one antenna array, wherein the antenna array comprises: a first insulator having a shape of a plate and having a conductive pattern formed thereon to allow the flow of an electrical signal; a first radiator disposed such that the lower end surface thereof is spaced a predetermined first length apart from the upper end surface of the first insulator; a second radiator spaced a predetermined second length apart from the first radiator on
(Continued)

a horizontal plane on which the first radiator is disposed; at least one feeder unit electrically connected to the conductive pattern to supply an electrical signal to the first radiator and the second radiator; and a second insulator disposed on the upper end surface of the first insulator to fix the at least one feeder unit such that the at least one feeder unit is spaced a predetermined third length apart from the lower end surface of the horizontal plane on which the first radiator and the second radiator are arranged.

15 Claims, 7 Drawing Sheets

(51) Int. Cl.
*H01Q 21/06* (2006.01)
*H01Q 1/24* (2006.01)
*H01Q 1/42* (2006.01)

(58) Field of Classification Search
CPC .. H01Q 21/0025; H01Q 21/06; H01Q 21/061; H01Q 21/065; H01Q 21/08
See application file for complete search history.

(56) References Cited

U.S. PATENT DOCUMENTS

2005/0206575 A1* 9/2005 Chadwick ..... H01Q 21/0087 343/797
2006/0220962 A1* 10/2006 d'Hont ..... H01Q 1/523 343/700 MS
2007/0257844 A1 11/2007 Chang et al.
2010/0182213 A1* 7/2010 Obermaier ..... H01Q 1/246 343/817
2013/0044035 A1* 2/2013 Zhuang ..... H01Q 5/50 343/770
2017/0179610 A1 6/2017 Watson
2017/0194703 A1 7/2017 Watson
2017/0222306 A1 8/2017 Biscontini et al.
2020/0321711 A1* 10/2020 Baek ..... H05K 1/181

FOREIGN PATENT DOCUMENTS

| | | | |
|---|---|---|---|
| CN | 102570055 | A | 7/2012 |
| CN | 103956587 | A | 7/2014 |
| CN | 105655702 | A | 6/2016 |
| CN | 205335424 | U | 6/2016 |
| CN | 107528115 | A | 12/2017 |
| EP | 3098903 | A1 | 11/2016 |
| JP | H08-181531 | A | 7/1996 |
| JP | 2005-039330 | A | 2/2005 |
| KR | 10-2009-0057537 | A | 6/2009 |
| KR | 10-2010-0035396 | A | 4/2010 |

OTHER PUBLICATIONS

First Office Action in connection with Chinese Application No. 201980009202.3 dated Dec. 3, 2020, 26 pages.
International Search Report and Written Opinion of the International Searching Authority in connection with International Application No. PCT/KR2019/000842 dated May 3, 2019, 12 pages.
The Second Office Action dated Jun. 28, 2021 in connection with Chinese Application No. 201980009202.3, 27 pages.

* cited by examiner

ANTENNA MODULE INCLUDING INSULATOR, AND BASE STATION INCLUDING SAME ANTENNA MODULE

CROSS-REFERENCE TO RELATED APPLICATIONS

This application is a 371 National Stage of International Application No. PCT/KR2019/000842, filed Jan. 21, 2019, which claims priority to Korean Patent Application No. 10-2018-0007077, filed Jan. 19, 2018, the disclosures of which are herein incorporated by reference in their entirety.

BACKGROUND

1. Field

The present disclosure relates to an antenna module used in a next generation communication technology and to a base station including the same.

2. Description of Related Art

In order to satisfy the increasing demands of radio data traffic after the commercialization of a 4G communication system, efforts have been made to develop an advanced 5G communication system or a pre-5G communication system. For this reason, the 5G communication system or the pre-5G communication system is also referred to as a beyond-4G network communication system or a post-LTE system. In order to accomplish a higher data transfer rate, the implementation of the 5G communication system in a super-high frequency (mmWave) band (e.g., about a 60 GHz band) is being considered. Also, in order to obviate a propagation loss of a radio wave and increase a delivery distance of a radio wave in the super-high frequency band, discussions for the 5G communication system are underway about various techniques such as a beamforming, a massive MIMO, a full dimensional MIMO (FD-MIMO), an array antenna, an analog beam-forming, and a large scale antenna. Additionally, for an improvement in network of the 5G communication system, technical developments are being made in an advanced small cell, a cloud radio access network (cloud RAN), an ultra-dense network, a device to device (D2D) communication, a wireless backhaul, a moving network, a cooperative communication, coordinated multi-points (CoMP), a reception-end interference cancellation, and the like. Also, in the 5G communication system, a hybrid FSK and QAM modulation (FQAM) and a sliding window superposition coding (SWSC) are developed as advanced coding modulation (ACM) schemes, and a filter bank multi carrier (FBMC), a non-orthogonal multiple access (NOMA), and a sparse code multiple access (SCMA) are also developed as advanced access techniques.

Meanwhile, the Internet, which is a human centered connectivity network where humans generate and consume information, is now evolving to the Internet of things (IoT) where distributed entities, such as things, exchange and process information without human intervention. Further, the Internet of everything (IoE), which is a combination of IoT technology and big data processing technology through connection with a cloud server, has emerged. As technology elements, such as sensing technology, wired/wireless communication and network infrastructure, service interface technology, and security technology, have been demanded for IoT implementation, a sensor network, machine-to-machine (M2M) communication, machine type communication (MTC), and so forth have been recently researched. Such an IoT environment may provide intelligent Internet technology services that create a new value to human life by collecting and analyzing data generated among connected things. The IoT may be applied to a variety of fields including smart home, smart building, smart city, smart car or connected car, smart grid, health care, smart appliances, advanced medical service, etc. through convergence and combination between existing information technology (IT) and various industrial applications.

In line with this, various attempts have been made to apply the 5G communication system to the IoT network. For example, technologies such as a sensor network, machine type communication (MTC), and machine-to-machine (M2M) communication are being implemented on the basis of 5G communication technologies such as beamforming, MIMO, and an array antenna. The use of a cloud radio access network (cloud RAN) for big data processing technology is one example of convergence between the 5G technology and the IoT technology.

SUMMARY

The next generation communication system may use a super-high frequency (mmWave) band. Thus, in order to use the next generation communication system, an antenna module structure capable of smooth communication even in the super-high frequency band is required. Accordingly, the disclosure is to provide an antenna module structure having high efficiency and gain and realizing a simplified manufacturing process in the next generation communication system.

The disclosure provides an antenna module including at least one antenna array, and the antenna array may include a first insulator having a plate shape and having a conductive pattern formed to allow an electrical signal to flow, a first radiator disposed to be spaced apart from an upper surface of the first insulator to a lower surface thereof by a predetermined first distance, a second radiator disposed to be spaced apart from the first radiator by a predetermined second distance on a horizontal plane where the first radiator is disposed, at least one feeder electrically connected to the conductive pattern and formed to supply electrical signals to the first and second radiators, and a second insulator disposed on the upper surface of the first insulator and fixing the at least one feeder to be spaced apart by a predetermined third distance from a lower surface of a horizontal plane where the first and second radiators are disposed.

The at least one feeder may include a first feeder having one end electrically connected to the conductive pattern, having other end spaced apart from a lower surface of the first radiator by the third distance, and supplying an electrical signal related to horizontal polarization to the first radiator, a second feeder having one end electrically connected to the conductive pattern, having other end spaced apart from the lower surface of the first radiator by the third distance, and supplying an electrical signal related to vertical polarization to the first radiator, a third feeder having one end electrically connected to the conductive pattern, having other end spaced apart from a lower surface of the second radiator by the third distance, and supplying an electrical signal related to horizontal polarization to the second radiator, and a fourth feeder having one end electrically connected to the conductive pattern, having other end spaced apart from the lower surface of the second radiator by the third distance, and supplying an electrical signal related to vertical polarization to the second radiator.

Each of the first, second, third, and fourth feeders may include a first segment forming a right angle with the upper surface of the first insulator and extending toward the first or second radiator, and a second segment forming a right angle with the first segment and being spaced apart by the third distance from, in parallel with, the lower surface of the horizontal plane where the first and second radiators are disposed.

An extension line of the second segment of the first feeder and an extension line of the second segment of the second feeder may form a right angle with each other, and an extension line of the second segment of the third feeder and an extension line of the second segment of the further feeder may form a right angle with each other.

The antenna array may further include a third insulator disposed on the upper surface of the first insulator and fixing the first and second radiators such that lower surfaces of the first and second radiators are spaced apart from the upper surface of the first insulator by the first distance.

The antenna array may further include a radome disposed on the upper surface of the first insulator and having a first radiator mounting portion and a second radiator mounting portion such that the first and second radiators are fixed to and spaced apart from the upper surface of the first insulator by the first distance.

The antenna array may further include a partition wall having a metallic material and disposed between the first radiator and the second radiator.

The antenna array may further include a wireless communication chip or circuit board disposed on a lower surface of the first insulator and supplying an electrical signal to the at least one feeder.

The disclosure provides a base station including a plurality of antenna arrays, and the antenna array may include a first insulator having a plate shape and having a conductive pattern formed to allow an electrical signal to flow, a first radiator disposed to be spaced apart from an upper surface of the first insulator to a lower surface thereof by a predetermined first distance, a second radiator disposed to be spaced apart from the first radiator by a predetermined second distance on a horizontal plane where the first radiator is disposed, at least one feeder electrically connected to the conductive pattern and formed to supply electrical signals to the first and second radiators, and a second insulator disposed on the upper surface of the first insulator and fixing the at least one feeder to be spaced apart by a predetermined third distance from a lower surface of a horizontal plane where the first and second radiators are disposed.

The at least one feeder may include a first feeder having one end electrically connected to the conductive pattern, having other end spaced apart from a lower surface of the first radiator by the third distance, and supplying an electrical signal related to horizontal polarization to the first radiator, a second feeder having one end electrically connected to the conductive pattern, having other end spaced apart from the lower surface of the first radiator by the third distance, and supplying an electrical signal related to vertical polarization to the first radiator, a third feeder having one end electrically connected to the conductive pattern, having other end spaced apart from a lower surface of the second radiator by the third distance, and supplying an electrical signal related to horizontal polarization to the second radiator, and a fourth feeder having one end electrically connected to the conductive pattern, having other end spaced apart from the lower surface of the second radiator by the third distance, and supplying an electrical signal related to vertical polarization to the second radiator.

Each of the first, second, third, and fourth feeders may include a first segment forming a right angle with the upper surface of the first insulator and extending toward the first or second radiator, and a second segment forming a right angle with the first segment and being spaced apart by the third distance from, in parallel with, the lower surface of the horizontal plane where the first and second radiators are disposed.

An extension line of the second segment of the first feeder and an extension line of the second segment of the second feeder may form a right angle with each other, and an extension line of the second segment of the third feeder and an extension line of the second segment of the further feeder may form a right angle with each other.

The antenna array may further include a third insulator disposed on the upper surface of the first insulator and fixing the first and second radiators such that lower surfaces of the first and second radiators are spaced apart from the upper surface of the first insulator by the first distance.

The antenna array may further include a radome disposed on the upper surface of the first insulator and having a first radiator mounting portion and a second radiator mounting portion such that the first and second radiators are fixed to and spaced apart from the upper surface of the first insulator by the first distance.

The antenna array may further include a partition wall having a metallic material and disposed between the first radiator and the second radiator.

The antenna array may further include a wireless communication chip or circuit board disposed on a lower surface of the first insulator and supplying an electrical signal to the at least one feeder.

The disclosure provides an antenna module structure in which a radiator and a feeder are disposed using an insulator or a radome. Therefore, compared to an antenna module structure using a printed circuit board (PCB), the cost of manufacturing an antenna module may be reduced.

In addition, according to an embodiment of the disclosure, the assembly mass productivity of the antenna module is improved, and thus the defective rate of the antenna module may be reduced.

In addition, according to an embodiment of the disclosure, adjusting the arrangement of feeders and disposing a partition wall between radiators may improve the performance of the antenna module and thus reduce the size of the antenna module.

DETAILED DESCRIPTION

Figure 1:
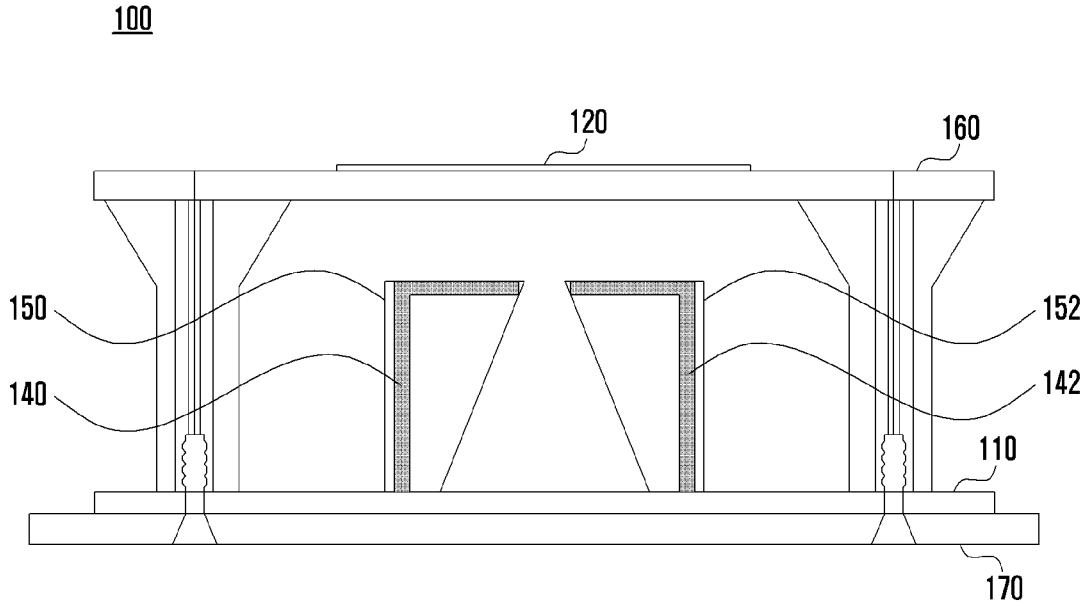
FIG. 1 is a side view showing an antenna array according to a first embodiment of the disclosure.

In the following description of embodiments, descriptions of techniques that are well known in the art and not directly related to the present invention are omitted. This is to clearly convey the subject matter of the disclosure by omitting any unnecessary explanation.

For the same reason, some elements in the drawings are exaggerated, omitted, or schematically illustrated. Also, the size of each element does not entirely reflect the actual size. In the drawings, the same or corresponding elements are denoted by the same reference numerals.

The advantages and features of the disclosure and the manner of achieving them will become apparent with reference to embodiments described in detail below and with reference to the accompanying drawings. The disclosure may, however, be embodied in many different forms and should not be construed as being limited to the embodiments set forth herein. Rather, these embodiments are provided so that the disclosure will be thorough and complete and will fully convey the scope of the disclosure to those skilled in the art. To fully disclose the scope of the disclosure to those skilled in the art, the disclosure is only defined by the scope of claims. In the disclosure, similar reference numbers are used to indicate similar constituent elements.

It will be understood that each block of the flowchart illustrations, and combinations of blocks in the flowchart illustrations, may be implemented by computer program instructions. These computer program instructions may be provided to a processor of a general purpose computer, special purpose computer, or other programmable data processing apparatus to produce a machine, such that the instructions, which are executed via the processor of the computer or other programmable data processing apparatus, generate means for implementing the functions specified in the flowchart block or blocks. These computer program instructions may also be stored in a computer usable or computer-readable memory that may direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that are executed on the computer or other programmable apparatus provide steps for implementing the functions specified in the flowchart block or blocks.

In addition, each block of the flowchart illustrations may represent a module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

The term "unit", as used herein, refers to a software or hardware component or device, such as a field programmable gate array (FPGA) or application specific integrated circuit (ASIC), which performs certain tasks. A unit may be configured to reside on an addressable storage medium and configured to execute on one or more processors. Thus, a module or unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or further separated into additional components and modules. In addition, the components and units may be implemented to operate one or more central processing units (CPUs) in a device or a secure multimedia card. Also, in embodiments, the unit may include one or more processors.

An antenna module structure disclosed herein may be applied to the next generation communication system. According to an embodiment, the antenna module structure disclosed herein may be applied to a communication system having an operating frequency of 6 GHz or less.

FIG. 1 is a side view showing an antenna array according to a first embodiment of the disclosure.

According to an embodiment, an antenna module 100 may include a first insulator 110 having a plate shape and having a conductive pattern formed to allow an electrical signal to flow, a first radiator 120 disposed to be spaced apart from an upper surface of the first insulator 110 to a lower surface thereof by a predetermined first distance, a first feeder 140 having one end electrically connected to the conductive pattern, having other end spaced apart from the lower surface of the first radiator 120 by a predetermined third distance, and supplying an electrical signal related to horizontal polarization to the first radiator 120, and a second feeder 142 having one end electrically connected to the conductive pattern, having other end spaced apart from the lower surface of the first radiator 120 by the third distance, and supplying an electrical signal related to vertical polarization to the first radiator 120.

According to an embodiment, the antenna module 100 may include a second insulator 150 disposed on the upper surface of the first insulator 110 and fixing the first feeder 140 to be spaced apart by the predetermined third distance from a lower surface of a horizontal plane on which the first radiator 120 is disposed, and a third insulator 152 disposed on the upper surface of the first insulator 110 and fixing the second feeder 142 to be spaced apart by the third distance from the lower surface of the horizontal plane on which the first radiator 120 is disposed.

According to an embodiment, the second and third insulators 150 and 152 may be formed separately from the first insulator 110, and the second and third insulators 150 and 152 may be bolted with the first insulator 110. (Bolting is only one example for combining the first insulator, the second insulator, and the third insulator, so that the scope of the disclosure should not be limited to this.)

According to an embodiment, the first feeder 140 and the second feeder 142 may have an shape. Each of the first and second feeders 140 and 142 may include a first segment forming a right angle with the upper surface of the first insulator 110 and extending toward the first radiator 120, and a second segment forming a right angle with the first segment and being spaced apart by the third distance from, in parallel with, the lower surface of the horizontal plane on which the first radiator 120 is disposed.

That is, each of the first and second feeders 140 and 142 may be supplied with an electrical signal from the conductive pattern of the first insulator 110 through the first segment, and may supply the electrical signal to the first radiator 120 through the second segment.

According to an embodiment, the third distance from the first radiator 120 to the first feeder 140 or the second feeder 142, or the area where the second segment of the first and second feeders 140 and 142 is overlapped with the first radiator 120 may be determined based on the frequency characteristics of radio waves to be radiated through the first radiator 120.

According to an embodiment, the first and second feeders 140 and 142 may have a gap-coupled structure with the first radiator 120. All of the first feeder 140, the second feeder 142, and the first radiator 120 may have a metallic material, and the first and second feeders 140 and 142 may be spaced apart from the first radiator 120 by the third distance. That is, the above-described structure may have an effect as if disposing a capacitor or an inductor between the first and second feeders 140 and 142 and the first radiator 120. This may make it possible to improve the bandwidth of radio waves emitted through the first radiator 120. According to an embodiment, the third distance may be determined based on the frequency characteristics (including a bandwidth) of radio waves emitted through the first radiator 120.

According to an embodiment, the antenna module 100 may include a fourth insulator 160 disposed on the upper surface of the first insulator 110 and fixing the first radiator 120 such that the lower surface of the first radiator 120 is spaced apart from the upper surface of the first insulator 110 by the first distance. According to an embodiment, the first distance may be determined based on the frequency characteristics (including a bandwidth) of radio waves emitted through the first radiator 120, and also the first distance may be determined in various ways according to a designer's need.

According to an embodiment, the fourth insulator 160 may be formed separately from the first insulator 110, and the fourth insulator 160 may be bolted with the first insulator 110. According to an embodiment, in the fourth insulator 160, the lower surface of the horizontal plane on which the first radiator 120 is disposed may be spaced apart from the upper surfaces of the second and third insulators 150 by the third distance.

According to an embodiment, a ground layer 170 may be disposed on a lower surface of the first insulator 110, and a wireless communication chip or circuit board for supplying electrical signals to the first and second feeders 140 and 142 may be disposed on a lower surface of the ground layer 170.

According to an embodiment, one antenna array may include two radiators. The antenna array structure including the two radiators will be described below with reference to FIG. 2.

Figure 2:
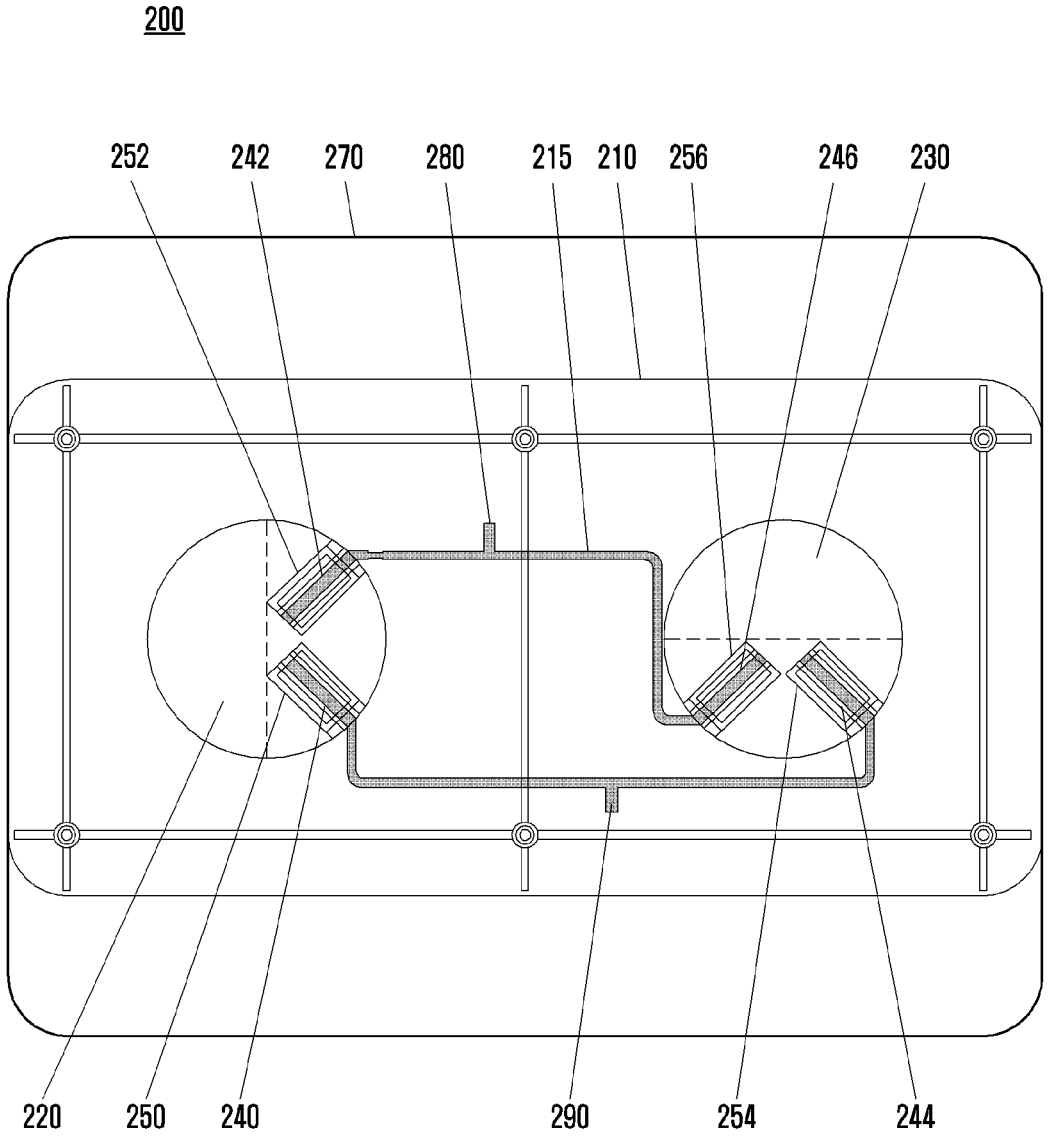
FIG. 2 is a plan view showing an upper surface of the antenna array according to the first embodiment of the disclosure.

FIG. 2 is a plan view showing an upper surface of the antenna array according to the first embodiment of the disclosure.

According to an embodiment, feeders 240, 242, 244, and 246 and insulators 250, 252, 254, and 256 for fixing the feeders may be disposed under a first radiator 220 and a second radiator 230. However, in FIG. 2, for convenience of description, the feeders 240, 242, 244, and 246 and the insulators 250, 252, 254, and 256 are illustrated as if penetrating the first and second radiators 220 and 230.

According to an embodiment, an antenna array 200 may include a first insulator 210 having a plate shape and having a conductive pattern 215 formed to allow an electrical signal to flow, a first radiator 220 disposed to be spaced apart from an upper surface of the first insulator 210 to a lower surface thereof by a predetermined first distance, and a second radiator 230 disposed to be spaced apart from the first radiator 220 by a predetermined second distance on a horizontal plane where the first radiator 220 is disposed.

The conductive pattern 215 may supply an electrical signal, received from a wireless communication chip or circuit board disposed on a lower surface of a ground layer 270, to the feeders 240, 242, 244, and 246. According to an embodiment, the conductive pattern may include a first port 290 for supplying an electrical signal related to horizontal polarization, and a second port 280 for supplying an electrical signal related to vertical polarization.

According to an embodiment, the horizontal polarization related electrical signal supplied through the first port 290 and the vertical polarization related electrical signal supplied through the second port 280 may be distributed by a distributor and then respectively supplied to the first radiator 220 and the second radiator 230.

According to an embodiment, the antenna array 200 may include a first feeder 240 having one end electrically connected to the conductive pattern 215, having other end spaced apart from the lower surface of the first radiator 220 by a predetermined third distance, and supplying an electrical signal related to horizontal polarization to the first radiator 220, a second feeder 242 having one end electrically connected to the conductive pattern 215, having other end spaced apart from the lower surface of the first radiator 220 by the third distance, and supplying an electrical signal related to vertical polarization to the first radiator 220, a third feeder 244 having one end electrically connected to the conductive pattern 215, having other end spaced apart from the lower surface of the second radiator 230 by the third distance, and supplying an electrical signal related to horizontal polarization to the second radiator 230, and a fourth feeder 246 having one end electrically connected to the conductive pattern 215, having other end spaced apart from the lower surface of the second radiator 230 by the third distance, and supplying an electrical signal related to vertical polarization to the second radiator 230.

According to an embodiment, an extension line of the first feeder 240 and an extension line of the second feeder 242 may form a right angle with each other, and also an extension line of the third feeder 244 and an extension line of the further feeder 246 may form a right angle with each other. Therefore, at the first and second radiators 220 and 230, isolation between vertical polarization and horizontal polarization may be improved.

According to an embodiment, the second feeder 242 supplying the electrical signal related to the vertical polarization to the first radiator 220 and the fourth feeder 246 supplying the electrical signal related to the vertical polarization to the second radiator 230 may have different arrangement forms. According to an embodiment, a path along which the vertical polarization related electrical signal supplied through the second port 280 reaches the second feeder 242, and a path along which the vertical polarization related electrical signal supplied through the second port 280 reaches the fourth feeder 244 may have a path difference. Due to this path difference, a 180-degree difference may exist between the phase of the electrical signal supplied through the second feeder 242 and the phase of the electrical signal supplied through the fourth feeder 246. According to an embodiment, the isolation between the first radiator 220 and the second radiator 230 may be improved because of a phase difference between the second feeder 242 and the fourth feeder 246, so that the performance of the antenna module can be improved.

According to an embodiment, the antenna array 200 may include a second insulator 250 disposed on the upper surface of the first insulator 210 and fixing the first feeder 240 to be spaced apart by the predetermined third distance from the lower surface of the horizontal plane on which the first radiator 220 is disposed.

According to an embodiment, the antenna array 200 may include a third insulator 252 disposed on the upper surface of the first insulator 210 and fixing the second feeder 242 to be spaced apart by the third distance from the lower surface of the horizontal plane on which the first radiator 220 is disposed.

According to an embodiment, the antenna array 200 may include a fourth insulator 254 disposed on the upper surface of the first insulator 210 and fixing the third feeder 244 to be spaced apart by the third distance from the lower surface of the horizontal plane on which the second radiator 230 is disposed.

According to an embodiment, the antenna array 200 may include a fifth insulator 256 disposed on the upper surface of the first insulator 210 and fixing the fourth feeder 246 to be spaced apart by the third distance from the lower surface of the horizontal plane on which the second radiator 230 is disposed.

Figure 3:
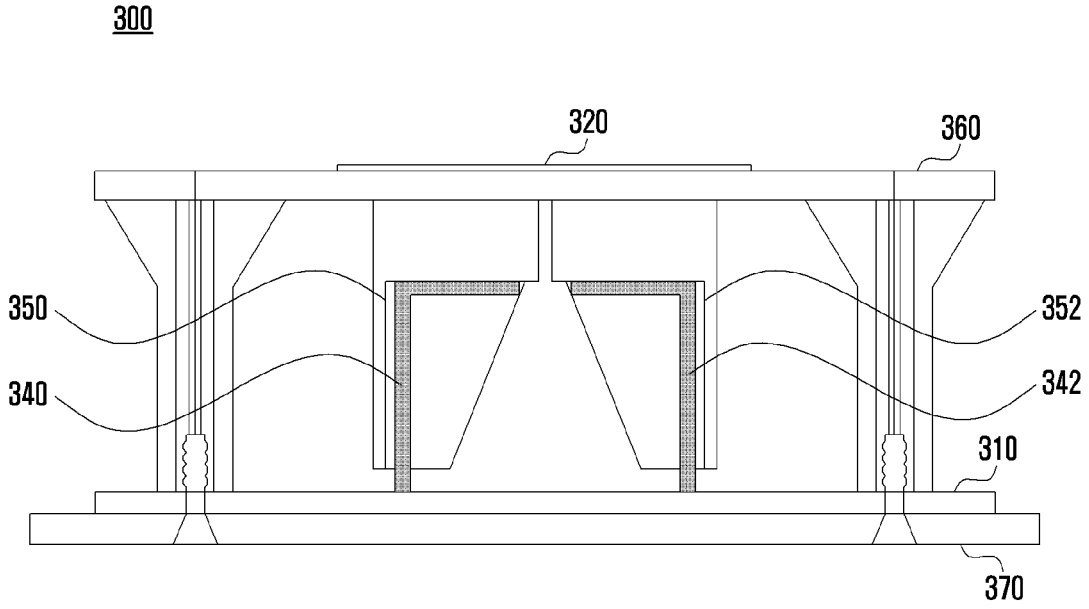
FIG. 3 is a side view showing an antenna array according to a second embodiment of the disclosure.

FIG. 3 is a side view showing an antenna array according to a second embodiment of the disclosure.

According to an embodiment, an antenna array 300 may include a fourth insulator 360 disposed on an upper surface of a first insulator 310 and fixing a first radiator 320 such that a lower surface of the first radiator 320 is spaced apart from the upper surface of the first insulator 310 by a predetermined first distance.

According to an embodiment, the antenna array 300 may include a second insulator 350 and a third insulator 352 fixing a first feeder 340 and a second feeder 342 to be spaced apart by a predetermined third distance from a lower surface of a horizontal plane on which the first radiator 320 is disposed.

According to an embodiment, the second insulator 350, the third insulator 352, and the fourth insulator 360 may be integrally formed. Alternatively, they may be formed separately and then combined with each other using bolting or adhesive.

Except that the second and third insulators 350 and 352 may be combined with the fourth insulator 360, the structure of the antenna array 300 (including a ground layer 370) shown in FIG. 3 may be the same as or similar to the structure of the antenna array 100 shown in FIG. 1.

Figure 4:
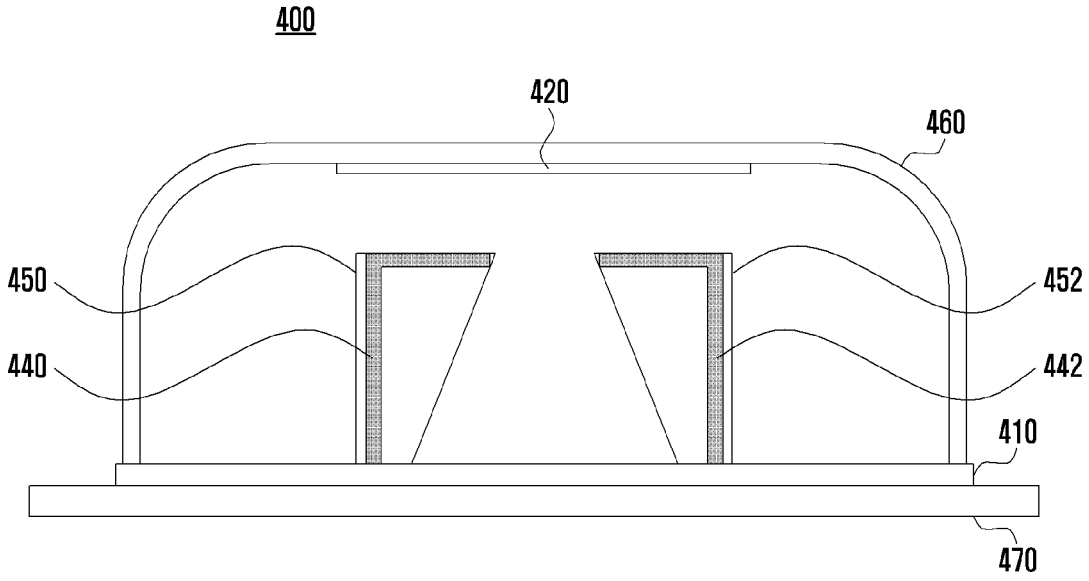
FIG. 4 is a side view showing an antenna array according to a third embodiment of the disclosure.

FIG. 4 is a side view showing an antenna array according to a third embodiment of the disclosure.

According to an embodiment, an antenna array 400 may include a radome 460 disposed on an upper surface of a first insulator 410 and having a first radiator mounting portion for fixing a first radiator 420 to be spaced apart from the upper surface of the first insulator 410 by a predetermined first distance.

Although FIG. 4 shows a case where only one radiator 420 is disposed on the radome 460, an antenna array structure in which two radiators are disposed on one radome 460 in accordance with the antenna array structure shown in FIG. 2 may also be considered.

According to an embodiment, a first feeder 440 fixed by a second insulator 450 may be disposed to be spaced apart from the first radiator 420 by a predetermined third distance, and a second feeder 442 fixed by a third insulator 452 may be disposed to be spaced apart from the first radiator 420 by the third distance. In this case, the third distance may be shorter than the first distance. According to an embodiment, the first feeder 440 and the second feeder 442 may supply an electrical signal related to horizontal polarization and an electrical signal related to vertical polarization to the first radiator 420, respectively.

Except that the radome 460 on which the first radiator 420 is disposed may be included in the antenna array 400, the structure of the antenna array 400 (including a ground layer 470) shown in FIG. 4 may be the same as or similar to the structure of the antenna array 100 shown in FIG. 1.

Figure 5:
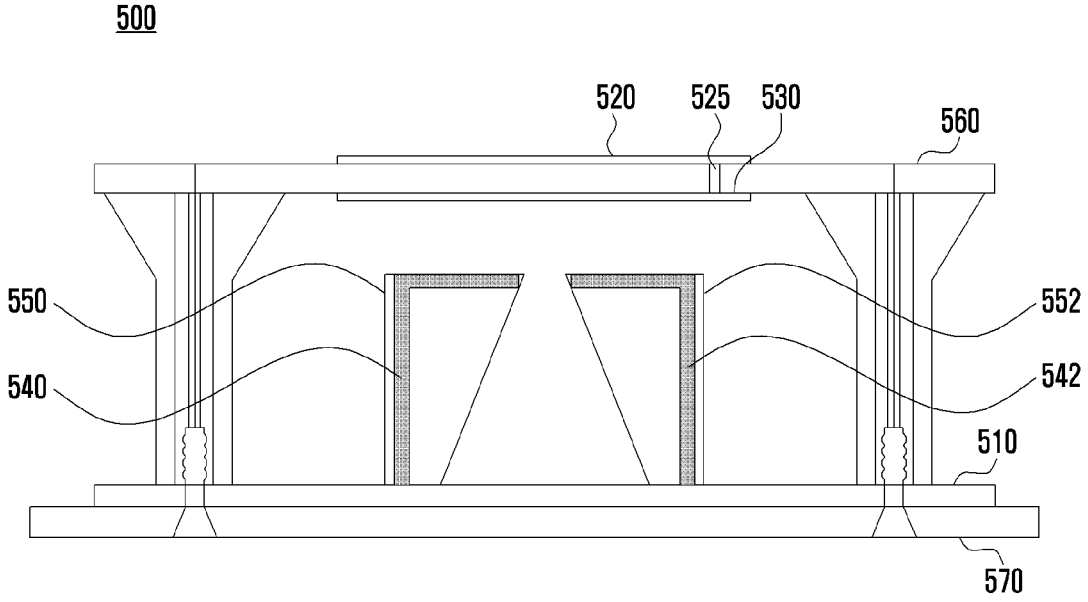
FIG. 5 is a side view showing an antenna array according to a fourth embodiment of the disclosure.

FIG. 5 is a side view showing an antenna array according to a fourth embodiment of the disclosure.

According to an embodiment, an antenna array 500 may include a third insulator 560 disposed on an upper surface of a first insulator 510 and fixing a first radiator 520 such that a lower surface of the first radiator 520 is spaced apart from the upper surface of the first insulator 510 by a predetermined first distance.

According to an embodiment, the first radiator 520 may be disposed on an upper surface of the third insulator 560, and a second radiator 530 may be disposed on a lower surface of the third insulator 560 to be opposite to the first radiator 520. The first radiator 520 and the second radiator 530 may be electrically connected to each other through a vertical interconnect access (VIA) 525.

According to an embodiment, the first and second radiators 520 and 530 may receive an electrical signal related to horizontal polarization and an electrical signal related to vertical polarization through a first feeder 540 and a second feeder 542.

According to an embodiment, the antenna array 500 is capable of radiating horizontal polarization and vertical polarization through two radiators 520 and 530, and thus may have an improved gain value in comparison with an antenna array structure radiating horizontal polarization and vertical polarization through one radiator.

Except that the first and second radiators 520 and 530 may be disposed on upper and lower surfaces of the third insulator 560, respectively, the structure of the antenna array 500 (including a ground layer 570 and second insulators 550 and 552) shown in FIG. 5 may be the same as or similar to the structure of the antenna array 100 shown in FIG. 1.

Figure 6:
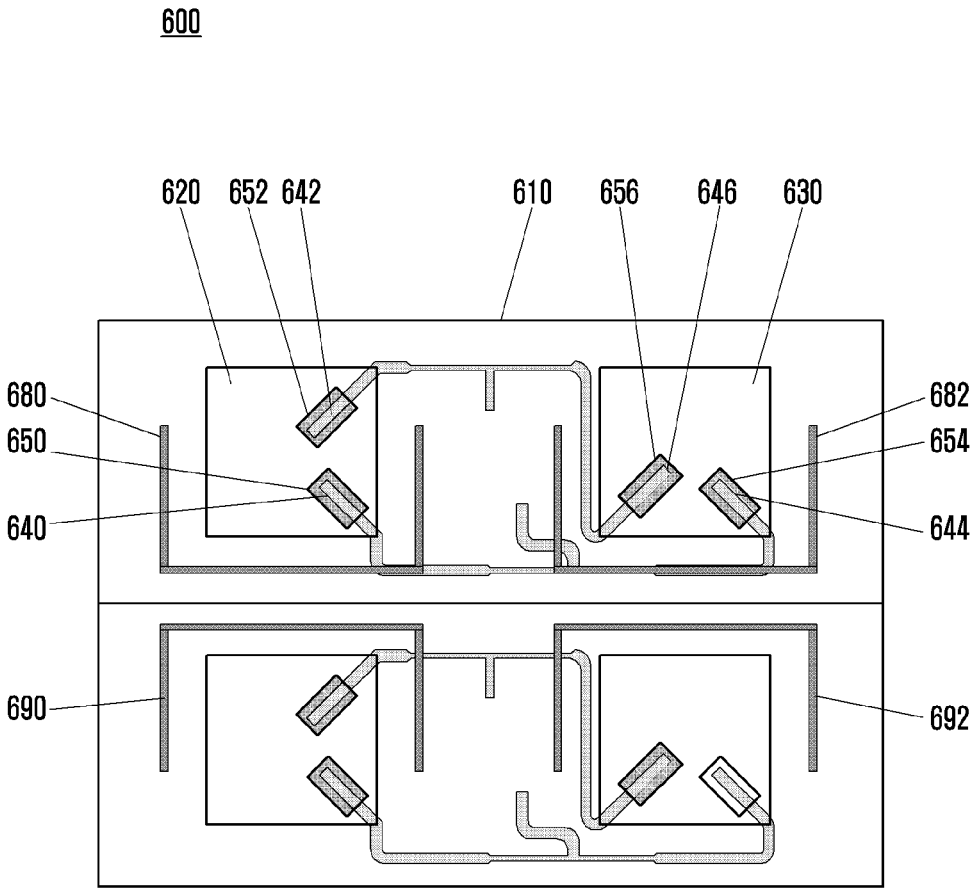
FIG. 6 is a view showing an antenna module according to an embodiment of the disclosure.

FIG. 6 is a view showing an antenna module according to an embodiment of the disclosure.

According to an embodiment, one antenna module 600 may include two antenna arrays. As described above in FIG. 2, one antenna array may include a first insulator 610 having a plate shape and having a conductive pattern formed to allow an electrical signal to flow, a first radiator 620 disposed to be spaced apart from an upper surface of the first insulator 610 to a lower surface thereof by a predetermined first distance, and a second radiator 630 disposed to be spaced apart from the first radiator 620 by a predetermined second distance on a horizontal plane where the first radiator 620 is disposed.

According to an embodiment, one or more partition walls 680 and 682 having a metallic material may be disposed between the first radiator 620 and the second radiator 630. The partition walls 680 and 682 may improve isolation between the first radiator 620 and the second radiator 630. That is, because of the partition walls 680 and 682, the probability that a radio wave emitted through the first radiator 620 interfere with a radio wave emitted through the second radiator 630 may be reduced.

According to an embodiment, the partition walls 680, 682, 690, and 692 may be disposed not only between the first and second radiators 620 and 630, but also between the antenna arrays. Therefore, isolation between the antenna arrays may be improved through the partition walls 680, 682, 690, and 692.

Meanwhile, the structures of feeders 640, 642, 644, and 646 and second insulators 650, 652, 654, and 656 shown in FIG. 6 may be the same as or similar to those shown in FIG. 2. In addition, although FIG. 6 shows only a case where two antenna arrays are disposed in one antenna module, the scope of the disclosure should not be limited thereto.

Figure 7:
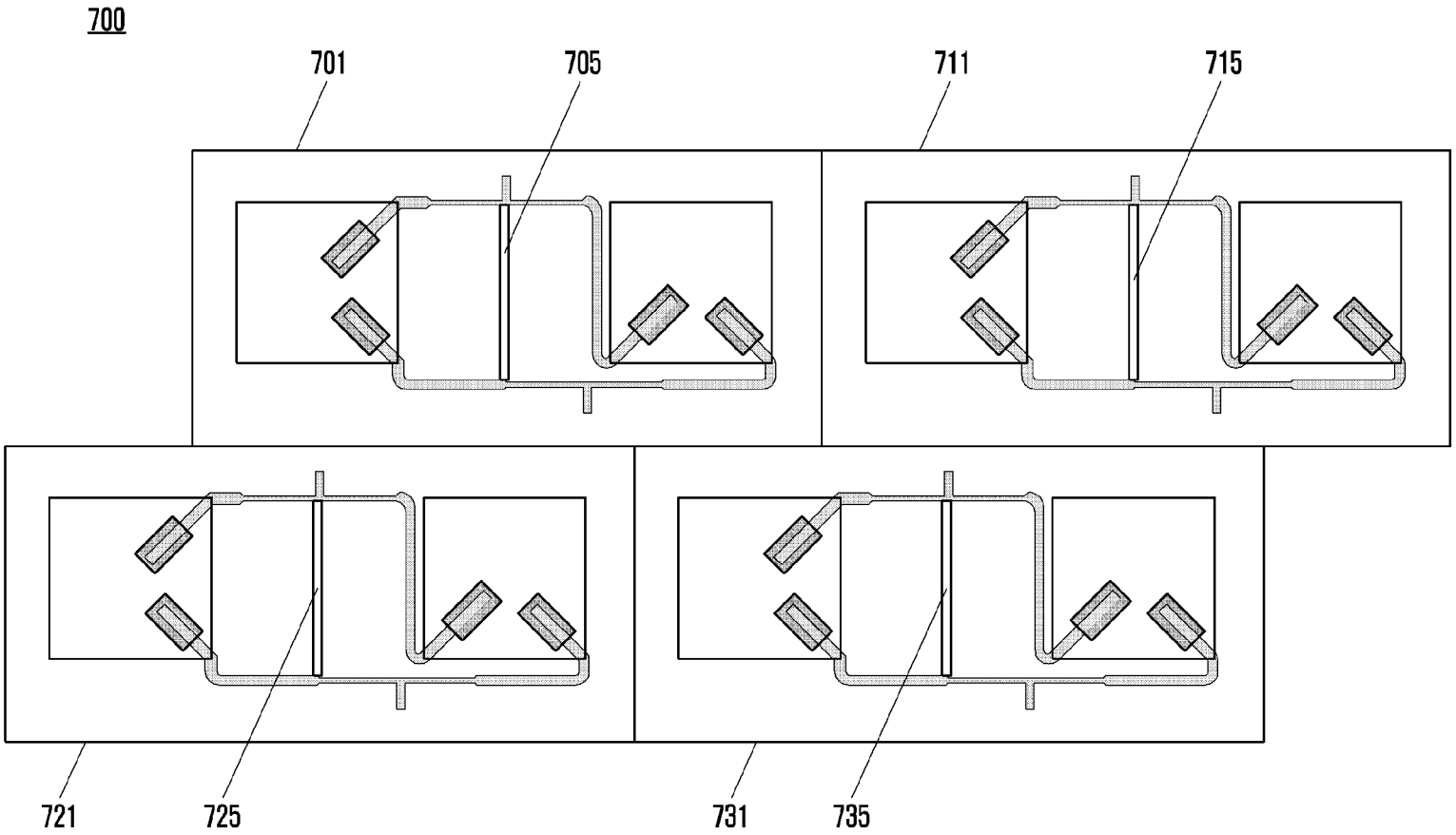
FIG. 7 is a view showing a base station according to an embodiment of the disclosure.

FIG. 7 is a view showing a base station according to an embodiment of the disclosure.

According to an embodiment, a base station 700 may include four antenna arrays 701, 711, 721, and 731. The structures of radiators, insulators, and feeders constituting each antenna array are as described in FIGS. 1 to 5.

According to an embodiment, each of the antenna arrays 701, 711, 721, and 731 may include a partition wall 705, 715, 725, or 735 having a metallic material and disposed between radiators constituting each antenna array. Through this, it is possible to improve the isolation of the antenna array.

While the disclosure has been described in detail with reference to specific embodiments, it is to be understood that various changes and modifications may be made without departing from the scope of the disclosure. In addition, the above-described embodiments may be selectively combined with each other if necessary. For example, some of the embodiments proposed in the disclosure may be combined with each other and used by a base station and a terminal.

The invention claimed is:

1. An antenna module comprising at least one antenna array, the antenna array including:

a first insulator having a plate shape and having a conductive pattern formed to allow an electrical signal to flow;

a first radiator disposed to be spaced apart from an upper surface of the first insulator to a lower surface thereof by a predetermined first distance;

a second radiator disposed to be spaced apart from the first radiator by a predetermined second distance on a horizontal plane where the first radiator is disposed;

at least one feeder electrically connected to the conductive pattern and formed to supply electrical signals to the first and second radiators; and a second insulator disposed on the upper surface of the first insulator and fixing the at least one feeder to be spaced apart by a predetermined third distance from a lower surface of a horizontal plane where the first and second radiators are disposed.

2. The antenna module of claim 1, wherein the at least one feeder includes:

a first feeder having one end electrically connected to the conductive pattern, having other end spaced apart from a lower surface of the first radiator by the third distance, and supplying an electrical signal related to horizontal polarization to the first radiator;

a second feeder having one end electrically connected to the conductive pattern, having other end spaced apart from the lower surface of the first radiator by the third distance, and supplying an electrical signal related to vertical polarization to the first radiator;

a third feeder having one end electrically connected to the conductive pattern, having other end spaced apart from a lower surface of the second radiator by the third distance, and supplying an electrical signal related to horizontal polarization to the second radiator; and a fourth feeder having one end electrically connected to the conductive pattern, having other end spaced apart from the lower surface of the second radiator by the third distance, and supplying an electrical signal related to vertical polarization to the second radiator.

3. The antenna module of claim 2, wherein each of the first, second, third, and fourth feeders includes:

a first segment forming a right angle with the upper surface of the first insulator and extending toward the first or second radiator, and a second segment forming a right angle with the first segment and being spaced apart by the third distance from, in parallel with, the lower surface of the horizontal plane where the first and second radiators are disposed.

4. The antenna module of claim 3, wherein an extension line of the second segment of the first feeder and an extension line of the second segment of the second feeder form a right angle with each other, and an extension line of the second segment of the third feeder and an extension line of the second segment of the further feeder form a right angle with each other.

5. The antenna module of claim 1, wherein the antenna array further includes a third insulator disposed on the upper surface of the first insulator and fixing the first and second radiators such that lower surfaces of the first and second radiators are spaced apart from the upper surface of the first insulator by the first distance.

6. The antenna module of claim 1, wherein the antenna array further includes a radome disposed on the upper surface of the first insulator and having a first radiator mounting portion and a second radiator mounting portion such that the first and second radiators are fixed to and spaced apart from the upper surface of the first insulator by the first distance.

7. The antenna module of claim 1, wherein the antenna array further includes a partition wall having a metallic material and disposed between the first radiator and the second radiator.

8. The antenna module of claim 1, wherein the antenna array further includes a wireless communication chip or circuit board disposed on a lower surface of the first insulator and supplying an electrical signal to the at least one feeder.

9. A base station comprising a plurality of antenna arrays, the antenna array including:

a first insulator having a plate shape and having a conductive pattern formed to allow an electrical signal to flow;

a first radiator disposed to be spaced apart from an upper surface of the first insulator to a lower surface thereof by a predetermined first distance;

a second radiator disposed to be spaced apart from the first radiator by a predetermined second distance on a horizontal plane where the first radiator is disposed;

at least one feeder electrically connected to the conductive pattern and formed to supply electrical signals to the first and second radiators; and a second insulator disposed on the upper surface of the first insulator and fixing the at least one feeder to be spaced apart by a predetermined third distance from a lower surface of a horizontal plane where the first and second radiators are disposed.

10. The base station of claim 9, wherein the at least one feeder includes:

a first feeder having one end electrically connected to the conductive pattern, having other end spaced apart from a lower surface of the first radiator by the third distance, and supplying an electrical signal related to horizontal polarization to the first radiator;

a second feeder having one end electrically connected to the conductive pattern, having other end spaced apart from the lower surface of the first radiator by the third distance, and supplying an electrical signal related to vertical polarization to the first radiator;

a third feeder having one end electrically connected to the conductive pattern, having other end spaced apart from a lower surface of the second radiator by the third distance, and supplying an electrical signal related to horizontal polarization to the second radiator; and a fourth feeder having one end electrically connected to the conductive pattern, having other end spaced apart from the lower surface of the second radiator by the third distance, and supplying an electrical signal related to vertical polarization to the second radiator.

11. The base station of claim 10, wherein each of the first, second, third, and fourth feeders includes:

a first segment forming a right angle with the upper surface of the first insulator and extending toward the first or second radiator, and a second segment forming a right angle with the first segment and being spaced apart by the third distance from, in parallel with, the lower surface of the horizontal plane where the first and second radiators are disposed.

12. The base station of claim 11, wherein an extension line of the second segment of the first feeder and an extension line of the second segment of the second feeder form a right angle with each other, and an extension line of the second segment of the third feeder and an extension line of the second segment of the further feeder form a right angle with each other.

13. The base station of claim 9, wherein the antenna array further includes a third insulator disposed on the upper surface of the first insulator and fixing the first and second radiators such that lower surfaces of the first and second radiators are spaced apart from the upper surface of the first insulator by the first distance.

14. The base station of claim 9, wherein the antenna array further includes a radome disposed on the upper surface of the first insulator and having a first radiator mounting portion and a second radiator mounting portion such that the first and second radiators are fixed to and spaced apart from the upper surface of the first insulator by the first distance.

15. The base station of claim 9, wherein the antenna array further includes a partition wall having a metallic material and disposed between the first radiator and the second radiator.

* * * * *